US007204360B2

(12) United States Patent
Rasmussen

(10) Patent No.: US 7,204,360 B2
(45) Date of Patent: Apr. 17, 2007

(54) COIN OR TOKEN ACTUATED MULTIPLE CHOICE SELECTOR

(76) Inventor: Stu Rasmussen, P.O. Box 1130, Mt. Angel, OR (US) 97362-1130

( * ) Notice: Subject to any disclaimer, the term of this patent is extended or adjusted under 35 U.S.C. 154(b) by 181 days.

(21) Appl. No.: 10/975,768

(22) Filed: Oct. 27, 2004

(65) Prior Publication Data

US 2005/0087423 A1 Apr. 28, 2005

Related U.S. Application Data

(60) Provisional application No. 60/515,296, filed on Oct. 28, 2003.

(51) Int. Cl.
*G07D 5/00* (2006.01)

(52) U.S. Cl. ..... 194/302

(58) Field of Classification Search ..... 194/302, 194/344, 351

See application file for complete search history.

(56) References Cited

U.S. PATENT DOCUMENTS 1,928,419 A * 9/1933 Gilmore et al. ..... 194/322
2,581,323 A * 1/1952 Gottschau ..... 194/313
3,372,783 A * 3/1968 Reedy, Jr. ..... 194/344
3,951,246 A 4/1976 Hall
3,974,352 A 8/1976 Pitel
4,243,134 A 1/1981 Chalabian
5,516,003 A 5/1996 Hebert
6,439,425 B1 8/2002 Masek

* cited by examiner

*Primary Examiner*—Patrick Mackey
*Assistant Examiner*—Mark J. Beauchaine

(57) ABSTRACT

A selection mechanism for vending machines or other similar uses in which a separate coin or token entry point is provided for each product or selection offered. Each of these entry points includes a sensing device to determine the presence of a coin as it passes through. When a customer inserts a coin into the desired selector entry point, the presence and passage of the coin is latched into a logic circuit or microcontroller memory. All of the entry points are mechanically aligned to steer the coins into the input funnel of a coin acceptor/validator mechanism. After the coin is subsequently confirmed to be genuine the selector mechanism provides an output signal to indicate the selected option.

1 Claim, 4 Drawing Sheets

SAMPLE FRONT PANEL
(USER INTERFACE)

SAMPLE FRONT PANEL
(USER INTERFACE)

MECHANICAL CONFIGURATION

MECHANICAL SEQUENCE
OF OPERATION

BASIC ELECTRICAL
CONFIGURATION

COIN OR TOKEN ACTUATED MULTIPLE CHOICE SELECTOR

CROSS REFERENCE TO RELATED APPLICATIONS

This application is entitled to the benefit of Provisional Patent Application Ser. No. 60/515,296 filed Oct. 28, 2003.

BACKGROUND—FIELD OF THE INVENTION

This invention relates generally to coin operated amusement and vending machine selection apparatus.

BACKGROUND—DESCRIPTION OF PRIOR ART

Coin operated product vending machines have traditionally been equipped with a single coin slot and coin acceptor/validator mechanism. In some cases, more than one coin slot and coin acceptor mechanism were incorporated into a device, but this was for the purpose of having a redundant backup system in the event that one mechanism failed or became jammed and unusable. The alternate coin slot and acceptor were simply connected in parallel with the primary device to allow continued machine operation until the primary devices were repaired.

Early vending machines used a single coin slot to dispense a single product. Think of a 'Gumball Machine" in which a coin is inserted, a lever is pushed and a gumball is dispensed. This operation is quick and easy—once the purchasing decision is made the transaction is consummated immediately upon inserting the coin and actuating the mechanism.

As vending machines became more versatile, machines were developed which used a single coin slot and acceptor mechanism to allow several different products to be dispensed from the same vending machine. For example, if a pack of cigarettes cost just twenty-five cents, a user would insert a quarter into the coin mechanism and then pull a lever or depress a mechanically actuated pushbutton to cause their selected product to be dispensed.

Gradually the prices of products being sold through vending machines increased past the point that a single coin of a standard denomination would pay for a purchase. Many mechanical and electrical/electronic credit and escrow mechanisms were devised to accumulate coinage values within a machine and then allow user selection of the desired product after the appropriate cash value was accumulated.

Subsequent to the development of the accumulator/escrow system, vending machines began to incorporate devices to return 'change' to the user if the inserted amount was greater than the price of the product selected.

Although all of these innovations increased the variety of merchandise vended in a single piece of equipment they had the undesirable side effect of slowing down the transaction process by requiring some time between the insertion of the coins and the user's selection of the desired product from amongst the differing varieties available.

In the case of a cigarette vending machine this was not a great handicap as the purchasers of such products had great brand loyalty and simply inserted their coin and actuated the mechanism corresponding to their predetermined selection. The situation was not as forthright if the product being dispensed were less specialized, such as a machine vending candy bars or similar product. The situation deteriorated further if the purchaser was a child who was dazed and confused by the variety of products offered and took time to carefully consider his/her decision as to which product to buy. Usually, a coin was inserted into the machine prior to a finalized decision being reached and subsequently a great deal of mental anguish ensued on the part of the purchaser—"Do I want the Milky Way or the Rocky Road?"—"No, wait, I think I'll have a Baby Ruth". During this 'decision time' the vending machine was unavailable for any other prospective user to make a purchase, thereby depriving the owner of the machine from revenue and denying prospective customers an opportunity to make their purchases in a timely manner.

The prior art as far as multiple selection vending machine operation has basically been 'cash first, decision second', which results in slow transaction turnaround and reduced profits for vending operators. A review of prior art shows many different variations on coin acceptor mechanisms, but none were discovered which encompass the 'decision first, then insert cash' nature of the current invention. As a representative sample of prior art, consider U.S. Pat. No. 4,503,961 granted to Chittleborough et.al. (1985) which uses a channel of varying size to sort coins of various denominations. There are also numerous coin validator inventions, a representative example of which is U.S. Pat. No. 3,998,309 issued to Mandas, et al. (1976) for a device which uses coin position detectors to track the speed of a coin as it passes through the device with the expectation of determining the genuineness of the coin through timing and other measurements. All these inventions disclosed are related to qualifying the coin and presuppose the customer's product selection will be made at a later time.

There have also been coin operated devices, most notably coin operated weighing devices or scales which incorporated multiple coin input slots as contemplated in the current invention. For example, the American Scale Co. of Washington D.C. built coin operated 'fortune telling' scales for many years which had coin slots labeled with the months of the year. The user was instructed to place a coin into the slot corresponding to the month of their birth in order to receive a 'fortune' which was appropriate to the customer's astral characteristics—or their shoe size—who knows? Functionally, all the coin slots were the same and simply directed all the coins to the scale mechanism without any differentiation. (The 'fortune' was provided by mechanically spinning a wheel and allowing a mechanically random selection from among multiple text messages on the periphery of the wheel.)

SUMMARY

A multiple choice coin or token accepting mechanism which incorporates multiple discrete coin entry channels, each of which indicates the operator's separate and distinct selection of product to be vended or option to be selected, and all sharing a single, common coin or token accepting/validating device.

Objects and Advantages

The objects of my invention are to provide an easy, quick and intuitive means of receiving customer input regarding the customer's choices of merchandise (or service) to be dispensed in a vending machine. In addition, if my invention were incorporated into a skill or knowledge based multiple choice game my invention would provide an easy and intuitive means of entering the player's desired selection amongst the multiple choices available and simultaneously collecting the entry fee for the game.

In addition, my invention shares the use of a single coin validation device to reduce the overall cost of manufacture. Other similar and dissimilar uses of the invention will be readily apparent to a person with skill in the art once the operation of the invention is fully described.

One advantage of my invention over existing similar devices is that the selection process for the user of the apparatus (and for the owner of the vending machine, if the device is incorporated into a vending machine) is that it greatly speeds the throughput of user access. In a conventional vending machine for example, a customer inserts a coin and then selects the desired merchandise through a button, lever or other selection mechanism. In many cases, the user is still in a rather hazy 'decision mode' when the coin is inserted. The customer knows he wants something, and has made the initial step of inserting money for the purchase, but is still deciding which of the items contained in the machine is the one he wishes to purchase. "Do I want a Butterfinger or a Rocky Road candy bar? During this period between insertion of the coin and final selection of the desired vending merchandise, the entire vending machine is unusable by any other customer. Because my invention has a separate coin or token slot for each product to be dispensed and the selected product will immediately be vended after insertion and validation of the coin, the customer must have made her purchasing decision prior to inserting the coin. The machine is then ready for the next customer without the intervening 'indecision time' between cash insertion and product delivery.

An additional advantage of my invention is that it utilizes only one 'coin acceptor' mechanism shared among several or many possible selections, thereby reducing the cost of the device as compared to one which has a similar operation but incorporates a separate coin acceptor mechanism for each coin slot. While standard mechanical coin acceptor mechanisms are currently available for about $10 to $30 each, the new generation of electronic coin acceptors or comparators are in the $50 to $150 range (each) and building a similar apparatus with a 'one acceptor per selection' would be very expensive.

Yet another advantage of my invention would be in its application to multiple choice interactive games of skill or knowledge such as coin-operated multi-player trivia games. By incorporating the invention into a system comprising such a game, my invention serves as the player's input terminal for selecting their desired answer to a question. The invention's hardware and software provide access to this user information as well as RTC (Real Time Clock) data to allow the game system to determine which users had the correct answer to a question and which of those users was first with the answer. In a similar vein, the invention could also be used in any sort of game or gaming device where multiple choice inputs are desired.

DRAWING FIGURES

I have included 4 drawings.

REFERENCE NUMERALS IN DRAWINGS

101 Coin or Token Entry Portal (1 per available selection)
102 Coin Channel or Race
103 Coin Presence Detector
104 Logic Circuit or Microprocessor
105 "Valid Coin" switch or sensor
106 Standard Coin Acceptor/Validator Mechanism
107 Electrical Output Connections to External Circuitry

DESCRIPTION

Figure 1:
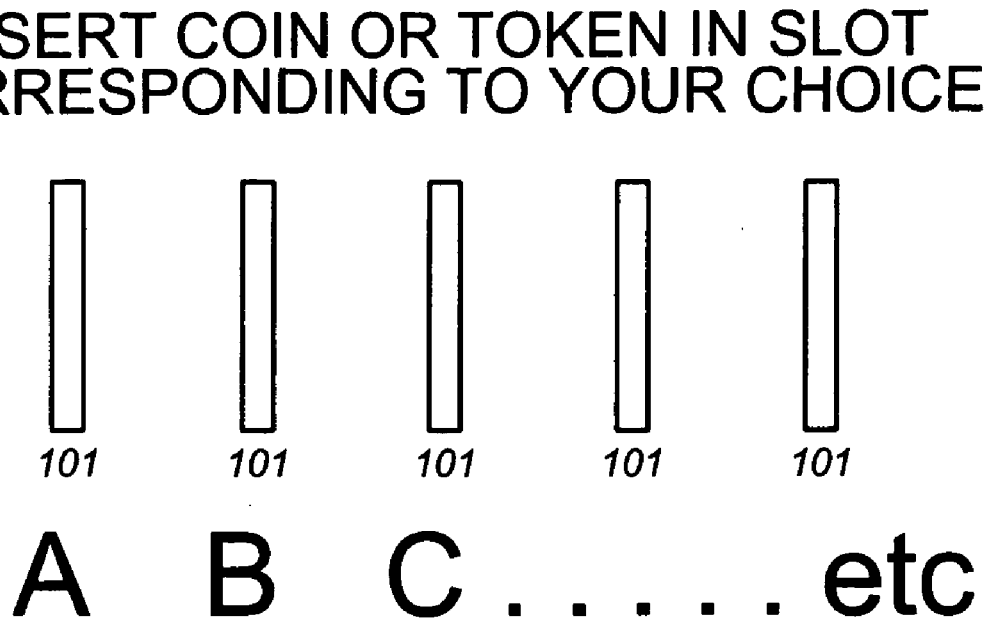
FIG. 1 is a sample front panel showing one possible layout of the coin or token entry portals.
Figure 2:
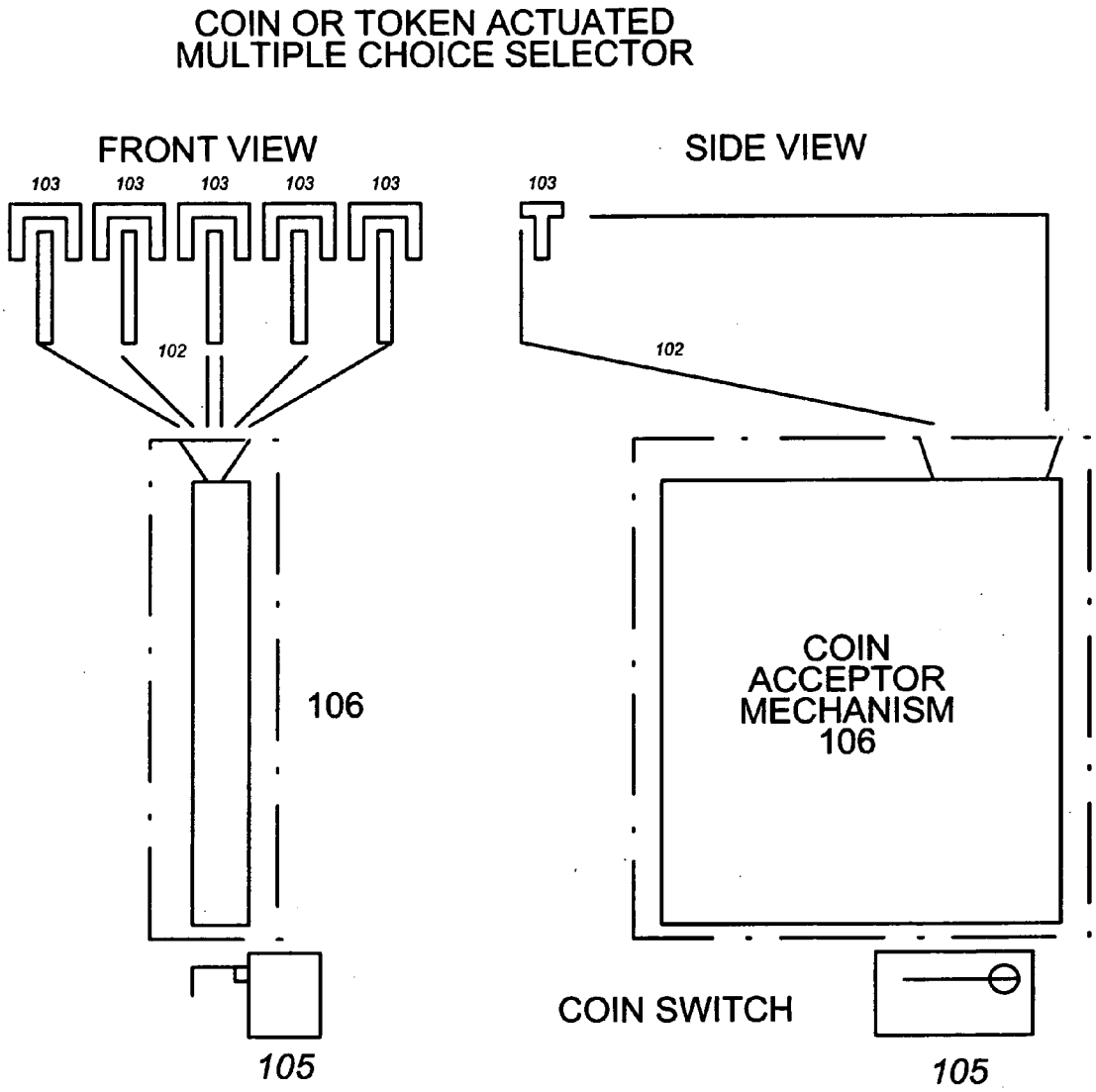
FIG. 2 is a conceptual drawing of the internal arrangement of a typical device showing the relative positions of the elements.

A separate coin or token entry portal 101 to the mechanism is provided on a user accessible external bezel or front panel for each possible choice or selection. Although FIG. 1 shows 5 coin entry points, any practical number can be accommodated either horizontally, vertically or as an X/Y array. Each entry point is a coin-sized slot on the front panel, which directs the inserted coin or token to a coin channel 102. There is one unique and distinct coin channel 102 for each entry point 101. The coin channels may be formed as 2, 3- or 4-sided hollow channels of sufficient size to allow free movement of coins contained therein. Each individual coin channel is curved, slanted and shaped to conduct the inserted coin through the channel to the exit point of the channel and into the entry point of a commercially available coin acceptor mechanism 106 which is not claimed as part of this invention. The coin channel may be slanted downward from the coin channel entry point to the coin acceptor entry point so that the force of gravity is sufficient to impel the coin through the channel without other external forces acting thereon.

The coin channels may be individual separate and distinct elements assembled as required to provide the number of unique selections desired, or multiple channels may be integrated into a single selection unit for ease and economy of manufacture.

At some point within each coin channel is a coin presence detector 103 to sense the passage of a coin through the individual coin channel. Said coin presence detector may be any sort of electronic or mechanical apparatus which provides an electrical signal or other suitable indication of the passage of an object through the channel. For purposes of illustration, we will assume that the coin presence detector is a commercially available electronic optical switch consisting of a light emitter and a light detector separated by a space through which a coin or token may pass. A typical device of this type is the OPB610 optical switch manufactured by Optek Technology, Inc., but other devices and methods of detecting the passage of a coin or token are readily apparent to a practitioner skilled in the craft. As the coin or token passes through the coin presence detector, a change in an electrical signal is created which is transmitted to a logic circuit or an input port on a microprocessor unit 104. There are many low-cost stored-program microprocessors suitable for this application such as the PIC-series from Microchip Corporation. The microprocessor unit 104 receives signal inputs from each of the coin presence detectors and the 'valid coin' switch 105 output from the coin acceptor's coin switch or data port. The internal program of the microprocessor evaluates these inputs and generates output signals corresponding to the inputs received.

Operation

Figure 3:
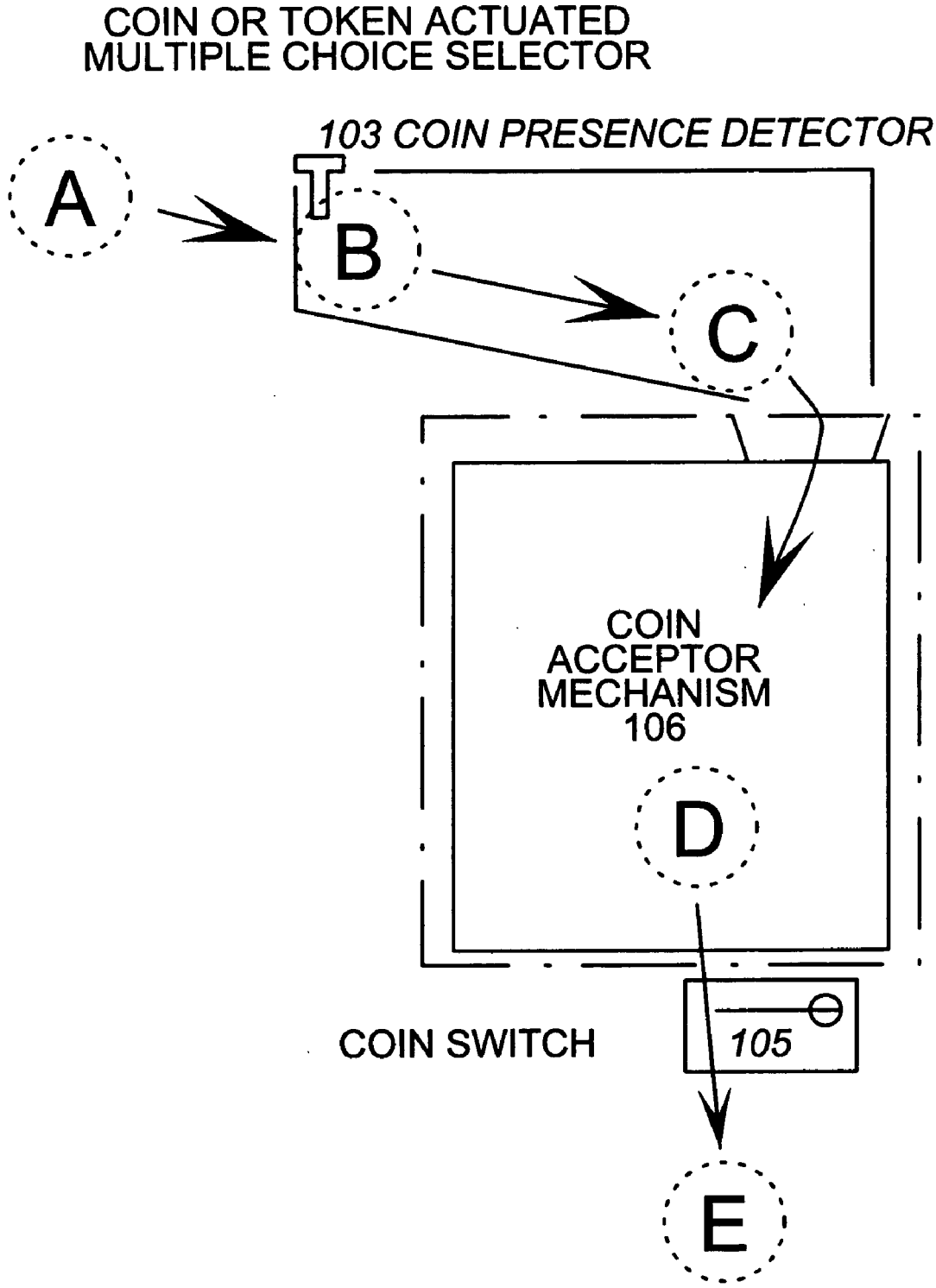
FIG. 3 shows the mechanical sequence of events as a coin or token travels through the device.
Figure 4:
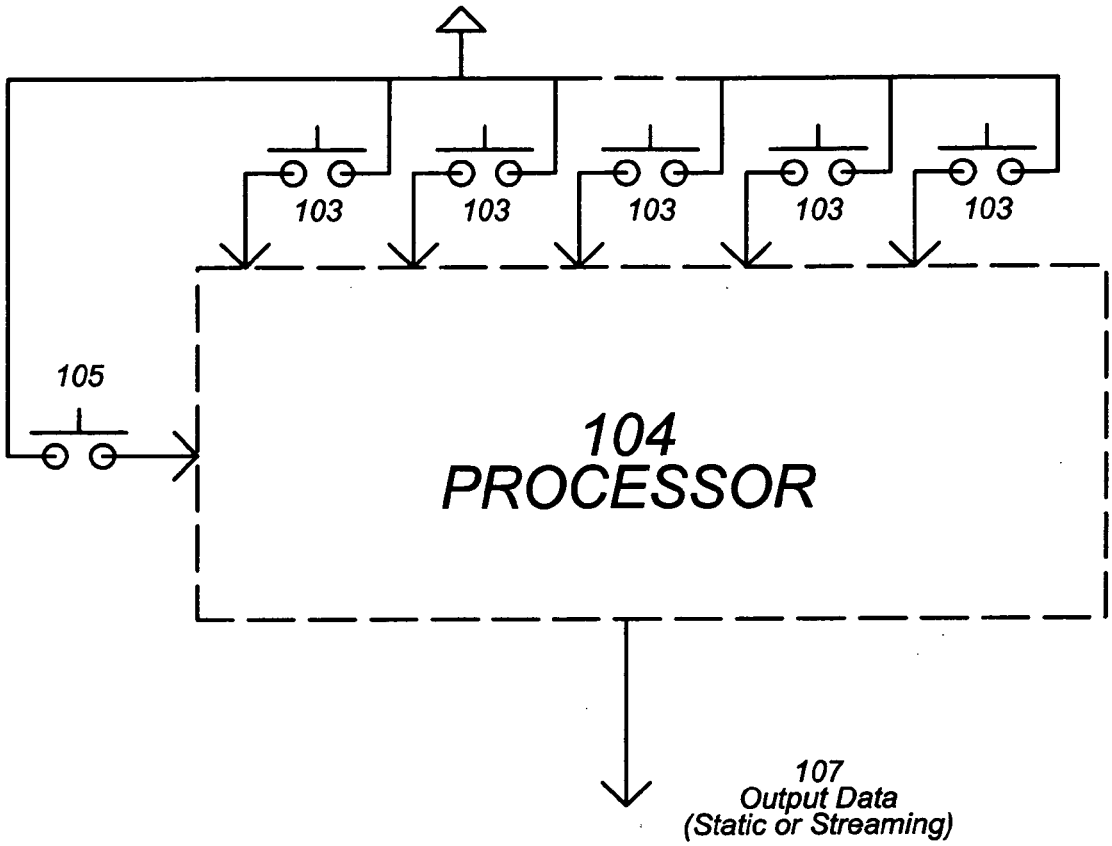
FIG. 4 is a block diagram of the embedded processor system external hardware configuration

The operation of the invention is as follows: Referring to FIG. 3, a coin or token is inserted into the front panel entry portal 101 corresponding to the user's desired selection. The coin passes through the entry portal (at position A) and directly into the individual coin channel associated with the input selection where it is acted upon by gravity or other mechanical impelling force to cause it to move toward the coin acceptor mechanism's input funnel. As the coin passes through the channel on its way to the coin acceptor mechanism, its passage through that particular coin channel is detected by the coin presence detector 103 as shown by position B in the coin channel. The logic circuit or microprocessor program is monitoring the data from the coin presence detectors continuously. Coin presence detector information is latched into a memory location within the microprocessor 104. The coin or token continues down the coin channel and into the coin acceptor mechanism as shown by coin positions C and D. Once the coin acceptor has determined that the coin or token is genuine, a signal from the output 105 of the coin acceptor is transmitted to the microprocessor. The valid coin, after triggering the output circuit of the coin acceptor or coin switch, drops through the mechanism at position E and into a suitable receptacle, which is not shown in the drawing. When the microprocessor has received both the input channel information and the 'valid coin' signal it then combines these two pieces of information into an output signal representing the selection in a format and manner to indicate the selection as needed by externally connected circuitry 107.

The coin channel 102 is shaped to direct the coin past the coin presence detector and to the input funnel of the coin acceptor mechanism. Each coin channel is angled or curved in such a way as to smoothly convey the coin to the coin acceptor without undue friction. The initial design and prototype of the invention used a solid block of plastic material with coin channels milled in a 3-dimensional arc from the coin slot to the coin acceptor. Subsequent experimentation showed that other manufacturing techniques were equally satisfactory and much less expensive to produce. Designs ranged from simple two-sided channels made of thin strips of sheet metal which were soldered to a metal substrate to a vacuum-formed multiple channel assembly made of thin acrylic plastic.

The microprocessor program accepts input information from the coin channel coin presence detectors and the current state of the coin acceptor output, processes this information received and creates an output based on that input data. One possible microprocessor program out of many possible programs would scan the coin channel input data and latch the data into a register whenever there was a coin, coins or tokens detected in the any of the coin channels. If no coin were detected, the last state in which the presence of a coin actually was detected would be held in the latch. When the coin acceptor mechanism indicated to the microprocessor that a valid coin was received, the latched data from the input coin channels would be provided as an output from the microprocessor to whatever device it was connected to in order to indicate the user's input choice. The output information could also include the exact or relative time at which the coin were inserted into the slot by latching an RTC (Real Time Clock) value at the time the last coin cleared the input channel coin presence detector in the event that the time of activation were needed by the host system. Such an application requiring RTC information might be a knowledge skill game device in which the first correct answer to a question determines the winner or some other similar scenario.

To reduce power consumption of the mechanism, the microprocessor program could alternately be written to sequentially illuminate the LED lamps in the coin presence detectors and then connecting the outputs of the optical switches in a 'wired or' or similar arrangement. The output of the 'wired or' switches would be monitored by the microprocessor and when an 'activated' switch were encountered it would correspond to whichever LED was currently illuminated, thereby identifying the user's selected input option.

As an anti-cheat mechanism the processor could also assure itself that only one coin channel were activated (latched) prior to receiving the coin acceptor input, and no coin was present in any of the coin presence detectors at the same time the coin acceptor output indicates a valid coin. The processor program could also monitor the length of time the coin acceptor output was received to determine that the coin was in a 'free fall' state rather than being held back or retained by the user through use of a string or adhesive.

The microprocessor program may also incorporate other routines and subroutines to accomplish other tasks within the coin mechanism, or the routine described previously may be incorporated into the processor program of another device which does coin channel selection and validation as a part of its overall operation.

Alternative Embodiments

There are various possibilities for different physical and mechanical arrangements to accomplish the same purpose as described above. For example, the drawings show the Coin presence detectors 103 at the top of the coin channel 102 and immediately adjacent to the coin input slot 101 on the front bezel.

The top placement for the coin presence detectors is preferable because any foreign matter or dirt that enters the coin slot will not lodge in the coin presence detector and cause a confusing indication.

Configuring the presence detector at the bottom of the channel would allow the mechanism to function with any denomination of coin by simply exchanging the coin acceptor mechanism 106 with one designed for the coin or token value desired.

Placing the coin presence detector at a location somewhat removed from the entry slot towards the interior of the mechanism would reduce or eliminate vandalism damage to the coin presence detector that might occur if it were proximate to the entry slot and would not interfere with the operation of the mechanism.

In addition, it may become desirable to incorporate timing circuits to latch the selection from the coin channel for only a limited time so that a bad coin that fails the validation test will not 'hang' the system. Also, it may be desirable to have an additional coin switch on the 'reject' port of the acceptor/validator mechanism to cancel the latched data if the coin is not validated as genuine.

Although different in form, these alternative configurations would still meet the criteria of the device operation and provide 'choice selection before validation of coin or token'.

Conclusion, Ramifications, and Scope

Accordingly, the reader will see that the invention provides a novel means for a user to make their selection and supply payment to a coin or token operated device, whether the selection is for a tangible product as in a vending application or simply as a multiple-choice input selector for a game of skill or other applications that may become apparent to one skilled in the art.

Although the descriptive information provided above contains many specificities, these should not be construed as limiting the scope of the invention but as merely providing illustrations of some of the presently developed or preferred embodiments of the invention. Mechanical variations in the physical shape or size of the components as well as variations in the software algorithm which could be applied to the operation of the invention are readily imagined and implemented. An optical sensor is mentioned in the description to detect the presence of a coin as it travels through the coin channel, but it is equally possible to use many other varieties of sensors as coin presence detectors such as Hall-effect devices or inductive couplers to indicate the presence of a coin.

Thus the scope of the invention should be determined by the appended claims and their legal equivalents rather than by the examples given.

What is claimed is:

1. A selection mechanism consisting of:

a plurality of primary coin channels with associated inlet portals, each of the channels being positioned and adapted to receive coins from its inlet portal and convey the coins via rolling or sliding motion to its outlet and thence into one standard coin acceptor mechanism which is shared by all of the primary coin channels and into which all the primary coin channels direct the inserted coins. Said coin acceptor mechanism is equipped with a signal device to indicate the presence of a valid coin;

a plurality of coin presence detector devices associated one each with said primary coin channels which detects the presence and passage of a coin within a particular channel as the coin travels through the channel;

a logic circuit which processes the information received from said channel coin presence detectors and the information received from said signal device associated with the single, shared coin acceptor mechanism and provides an output signal to indicate which of the input channels was activated.

* * * * *